US006310292B1

(12) United States Patent
Osborn

(10) Patent No.: US 6,310,292 B1
(45) Date of Patent: Oct. 30, 2001

(54) COMPRESSION SPLICE ADAPTERS

(75) Inventor: William G. Osborn, Stamford, CT (US)

(73) Assignee: Framatome Connectors USA, Inc., Norwalk, CT (US)

( * ) Notice: Subject to any disclaimer, the term of this patent is extended or adjusted under 35 U.S.C. 154(b) by 0 days.

(21) Appl. No.: 08/375,840

(22) Filed: Jan. 20, 1995

(51) Int. Cl.[7] ..... H01R 11/07
(52) U.S. Cl. ..... 174/84 C
(58) Field of Search ..... 174/84 C, 84 R, 174/88 R, 84 S, 94 R; 439/877

(56) References Cited

U.S. PATENT DOCUMENTS 2,199,892 * 5/1940 Metcalf ..... 287/75 X
3,390,227 * 6/1968 Shlesinger, Jr. ..... 174/84
3,404,216 * 10/1968 Amann et al. ..... 174/84
3,596,231 * 7/1971 Melton ..... 339/96
3,691,291 * 9/1972 Taj ..... 174/73 R X
4,829,146 * 5/1989 Duve ..... 174/94 R X

FOREIGN PATENT DOCUMENTS

3149048 * 6/1983 (DE) ..... 174/84 C

* cited by examiner

*Primary Examiner*—Chau N. Nguyen
(74) *Attorney, Agent, or Firm*—Perman & Green, LLP

(57) ABSTRACT

Reducing adapters for splicing electrical conductors of unequal size and particularly to compression splices fitted with one of more adapters for splicing a range of conductors of dissimilar sizes.

2 Claims, 2 Drawing Sheets

COMPRESSION SPLICE ADAPTERS

BACKGROUND OF THE INVENTION

The present invention relates to splicing electrical conductors of unequal size and particularly to compression splices fitted with one or more adapters for splicing a range of conductors of dissimilar sizes.

Compression sleeves or splices are commonly used in electrical distribution networks for joining conductors. A proper splice provides efficient electric conductivity with high pull out strength. In practice it is often necessary to splice conductors of different sizes such as compact stranded copper conductors and the next smaller standard splice sizes are sometimes used to provide more closely fitting sleeves. The smaller splices or tubes are approximately only 65% of the cross-section of the compact stranded conductor and produce a splice of inadequate capacity for the electrical load carried by the spliced conductors.

SUMMARY OF THE INVENTION

The present invention deals with the matter of providing an adequate splice connection between different size conductors by providing splice adapters resulting in a compression splice with close fitting internal diameter for each conductor forming the splice while retaining the original outside diameter of the finished splice for compression by a given size compression die. In accordance with the invention, a splice of dissimilar size conductors includes a joining sleeve with the larger size conductor inserted into one end of the sleeve, and with the smaller size conductor in concentric assembly with one or more tubular reducing adapters inserted into the other end of the sleeve. The sleeve-conductor-reducing adapter assembly is then compressed to complete the splice. The result is a splice having a cross-section larger than the conductor in most cases and always a more robust final product.

In accordance with the invention, each splice reducing adapter includes the following dimensional requirements: (i) suitable outside diameter to fit within the compression sleeve where it is to be used, (ii) suitable inside diameter to accommodate the conductor being spliced, (iii) suitable length to fit the compression sleeve where it is to be used, and (iv) to provide a cross-sectional area exactly the same as the difference in area it fills within the splice. In this way the total copper area (including sleeve and adapters) placed within the die of the compression tool is always the same whether one or multiple adapters are used for a splice.

An illustrative embodiment of the invention is disclosed which comprises a set of adapters made available to installers for splicing conductors selected from a group of six compact strand conductors of dissimilar size.

OBJECTS OF THE INVENTION

It is an object of the invention to provide for compression splicing of dissimilar size compact strand conductors.

It is an object of the invention to provide adapters used individually or collectively in concentric arrangement for compression splices of dissimilar size conductors.

It is a further object of the invention to provide adapters for compression splicing of a range of dissimilar size conductors in which the total copper area placed within a compression die is always the same.

Other and further objects of the invention will occur to one skilled in the art with an understanding of the following detailed description of the invention or upon employment of the invention in practice.

DESCRIPTION OF THE DRAWING

A preferred embodiment of the invention has been chosen for purposes of illustrating the construction and operation of the invention and is shown in the accompanying drawing in which.

DETAILED DESCRIPTION OF THE INVENTION

Figure 3:
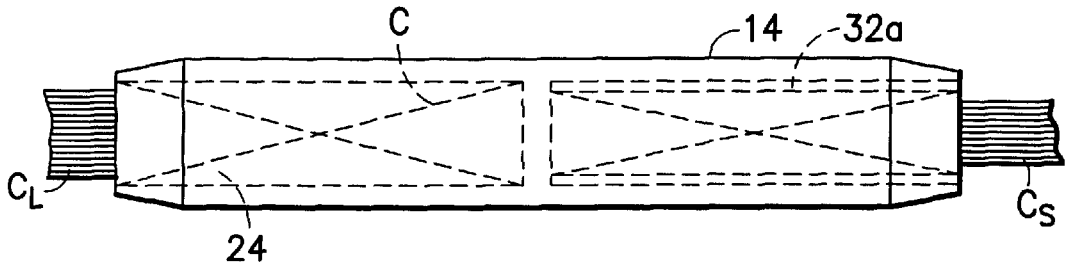
FIGS. 3 and 4 are illustrations of various splices formed using a compression sleeve and reducing adapters according to the invention.
Figure 4:
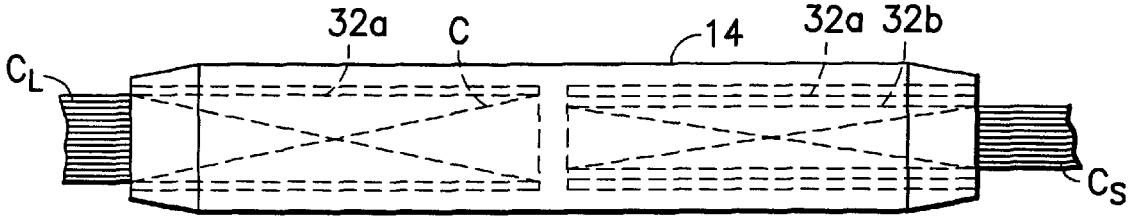

Referring to the drawing, a splicing sleeve 10 comprises an elongate cylindrical barrel 14 with tapered ends 16 and a central bore 18 passing entirely through the sleeve. The barrel has a generally cylindrical outer wall 15 with a plug 20 in the form of a disc brazed into position at the center 22 of the bore dividing the sleeve into first 24 and second 26 conductor receiving pockets lying along the cylinder axis x–x' with access openings 28, 30 at opposite ends of the sleeve for receiving compact copper conductors C (FIGS. 3 & 4). Each pocket has substantially the same dimensions of inside diameter and length measured from the midpoint 22 of the sleeve to the access opening of the pocket. Each of the pockets is designed and dimensioned to receive a specific compact copper conductor size, for example, a 750 kcmil conductor with an outside diameter of approximately 0.908". The splicing sleeve is preferably fabricated of tin plated copper. In practice, the splicing sleeve is marked to identify the correct crimping die for compression forming the splice.

Figure 1:
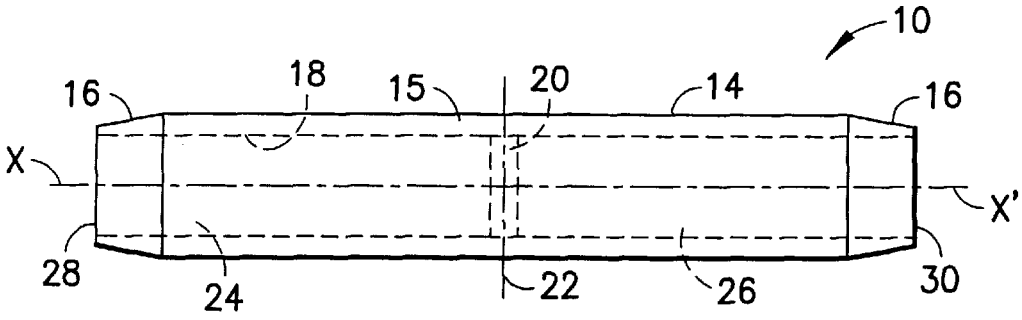
FIG. 1 is a side elevation of a compression sleeve used for receiving dissimilar size conductors and reducing adapters according to the invention.
Figures 2A, 2B, 2C, 2D, 2E:
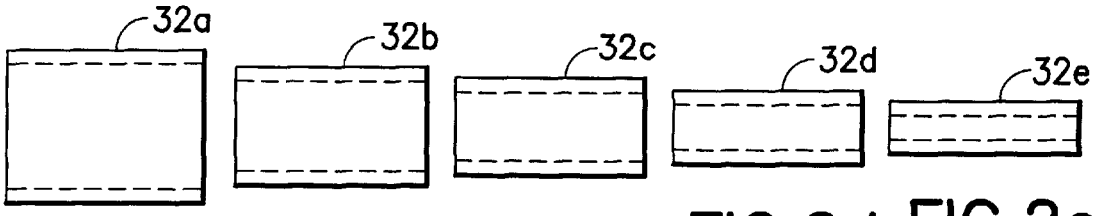
FIGS. 2 *a–e* are views of individual adapter tubes comprising a set for splicing a range of dissimilar size conductors.

A set of adapters 32 *a–e* in the form of hollow cylinders or tubes is illustrated in FIGS. 2 *a–e* with the entire set being dimensioned for concentric assembly with a conductor and with each other so the next smaller adapters fit into the next larger adapters with 32*a* receiving 32*b*; 32*b* receiving 32*c*; and so forth. In addition, the outside and inside diameters of each adapter correspond to standard compact copper conductor sizes such that the outside diameter is a given conductor size and the inside diameter is the next lower standard conductor size. In this way the adapter 32*a* positioned within the sleeve as shown in FIGS. 3 and 4 may receive either the next lower standard conductor size (600 kcmil in FIG. 3, e. g.) or the next smaller adapter 32*b* in FIG. 4. For the set of adapters shown in FIG. 2 *a–e*, the following are the outside and inside diameters expressed in terms of standard copper conductor size and conductor diameter.

| | Outside Diameter | Inside Diameter |
|---|---|---|
| 2a. | 750 kcmil (0.908") | 600 kcmil (0.813") |
| 2b. | 600 kcmil (0.813") | 500 kcmil (0.736") |
| 2c. | 500 kcmil (0.736") | 350 kcmil (0.616") |
| 2d. | 350 kcmil (0.616") | 250 kcmil (0.520") |
| 2e. | 250 kcmil (0.520") | 4/0 STR. (0.475") |

In this way, as shown in FIGS. 3 and 4 a given sleeve and compression tool may be used to provide interconnections of dissimilar size conductors with the total copper cross-sectional area as well as surface area of sleeve engaged by the compression tool always being the same regardless of what size conductors ares interconnected. For example, a 750 size conductor may be spliced to 350 size conductor by inserting the 750 conductor directly into one pocket of the sleeve, and by inserting a concentric assembly of the 350 conductor together with adapters 32*a*, 32*b*, and 32*c* into the other pocket of the sleeve. After crimping, the conductors are joined by a robust splice with high pull out strength and with a cross-section greater than that of the larger conductor.

In practice, it is desirable to provide sets of sleeves and adapters to accommodate to following groupings for splicing dissimilar size conductors:

| | | | | | |
|---|---|---|---|---|---|
| 1. | 750/600 | + | 600/500 | + | 500/350 |
| 2. | 600/500 | + | 500/350 | + | 350/250 or 4/0 |
| 3. | 500/350 | + | 350/250 or 4/0 | | |
| 4. | 350/250 or 4/0 | | | | |
| 5. | 4/0–1/0. | | | | |

In a preferred splice, the larger diameter conductor $C_L$ of FIG. 3 forming part of the splice is received directly into the sleeve pocket 24 without using adapters, that is , the inside diameter of the pocket matches the outside diameter of the conductor. However, an entirely suitable splice (FIG. 4) results from placing a concentric assembly of one or more reducing adapters around both the larger $C_L$ and smaller $C_S$ conductors, inserting the conductor/concentric assemblies into the respective sleeve pockets and crimping the sleeve in place. The result is a constant cross-sectional of copper in each pocket after the crimp.

Each of the foregoing splice reducing adapter sets accomplishes the following dimensional requirements of (i) suitable outside diameter to fit within the compression sleeve where it is to be used, (ii) suitable inside diameter to accommodate the conductor being spliced, (iii) suitable length to fit the compression sleeve where it is to be used, and (iv) provides a cross-sectional area exactly the same as the difference in area it fills within the splice. In this way the total copper area (including sleeve and adapters) placed within the die of the compression tool is always the same whether one or multiple adapters are used for a splice.

In the appended claims, a splice is recited in terms of the inside and outside diameters of splice components. Where an inside or outside diameter of one component is recited as being "substantially the same" as a diameter of another component, it is with an understanding that the diameters have appropriate clearance to allow assembly.

I claim:

1. A splice of dissimilar size compact stranded copper conductors in which the splice is characterized in having a constant cross-section of copper comprising an elongate tin plated copper splicing sleeve having a generally cylindrical outer wall defining first and second conductor receiving pockets lying along the cylinder axis with access openings at opposite ends of the sleeve, each pocket having substantially the same dimensions of inside diameter and length measured from the midpoint of the sleeve to the access opening of the pocket, a first conductor having an outside diameter substantially the same as the inside diameter of the pockets being inserted into said first conductor receiving pocket, a second conductor having an outside diameter less than the inside diameter of the pocket, a concentric assembly of at least one copper reducing adapter around said second conductor, the adapter having an outside diameter substantially the same as the inside diameter of the second pocket and an inside diameter substantially the same as the outside diameter of the second conductor, said at least one copper reducing adapter being cylindrical and having outside and inside diameters corresponding to standard compact conductor sizes such that the outside diameter is a given conductor size and the inside diameter is the next lower standard conductor size, the concentric assembly being inserted into the second pocket, and the sleeve crimped onto the first conductor and the concentric assembly of the second conductor and at least one reducing adapter to form a compression splice in which dissimilar size conductors are spliced with the same cross-sectional area of copper including sleeve, conductors and adapters within the first and second pockets of the sleeve.

2. A splice of dissimilar size compact stranded copper conductors in which the splice is characterized in having a constant cross-section of copper comprising an elongate tin plated copper splicing sleeve having a generally cylindrical outer wall defining first and second conductor receiving pockets lying along the cylinder axis with access openings at opposite ends of the sleeve, each pocket having substantially the same dimensions of inside diameter and length measured from the midpoint of the sleeve to the access opening of the pocket, a first conductor having an outside diameter less than the inside diameter of the pockets, a concentric assembly of at least one copper reducing adapter around said first conductor, the adapter having an outside diameter substantially the same as the inside diameter of the first pocket and an inside diameter substantially the same as the outside diameter of the first conductor, the concentric assembly being inserted into the first pocket, a second conductor having an outside diameter less than the inside diameter of the pockets, a concentric assembly of a plurality of copper reducing adapters around the second conductor, the concentric adapter assembly having an outside diameter substantially the same as the inside diameter of the second pocket and an inside diameter substantially the same as the outside diameter of the second conductor, the concentric assembly being inserted into the second pocket, each of said copper reducing adapters being cylindrical and having outside and inside diameters corresponding to standard compact conductor sizes such that the outside diameter is a given conductor size and the inside diameter is the next lower standard conductor size, and the sleeve crimped onto the first and second conductors and their respective concentric assemblies of adapters to form a compression splice in which dissimilar size conductors are spliced with the same cross-sectional area of copper including sleeve, conductors and adapters within the first and second pockets of the sleeve.

* * * * *